US005705305A

United States Patent [19]

Ohta et al.

[11] Patent Number: 5,705,305

[45] Date of Patent: Jan. 6, 1998

[54] DEVELOPER FOR DEVELOPING ELECTROSTATIC LATENT IMAGE

[75] Inventors: Mitsuru Ohta; Noriaki Satoh, both of Nagoya, Japan

[73] Assignee: Brother Kogyo Kabushiki Kaishi, Nagoya, Japan

[21] Appl. No.: 589,469

[22] Filed: Jan. 22, 1996

[30] Foreign Application Priority Data

Jan. 31, 1995 [JP] Japan ..... 7-036069

[51] Int. Cl.[6] ..... G03G 9/097

[52] U.S. Cl. ..... 430/110; 430/126

[58] Field of Search ..... 430/110

[56] References Cited

U.S. PATENT DOCUMENTS

| | | | |
|---|---|---|---|
| 4,780,390 | 10/1988 | Hosoi | 430/138 |
| 4,935,782 | 6/1990 | Kohyama et al. | 430/110 |
| 5,212,037 | 5/1993 | Julien et al. | 430/110 |
| 5,439,772 | 8/1995 | Takagi et al. | 430/110 |
| 5,486,443 | 1/1996 | Grande et al. | 430/110 |
| 5,504,559 | 4/1996 | Ojima et al. | 430/126 |

FOREIGN PATENT DOCUMENTS

| | | |
|---|---|---|
| 62-129866 | 6/1987 | Japan . |
| 62-209538 | 9/1987 | Japan . |
| 2-27664 | 6/1990 | Japan . |
| 7-199517 | 8/1995 | Japan . |

*Primary Examiner*—Roland Martin
*Attorney, Agent, or Firm*—Oliff & Berridge, P.L.C.

[57] ABSTRACT

A developer for developing an electrostatic latent image formed on an photosensitive body, including a toner, a fluidity improving material, a cleaning material, and hydrophobic fine particles obtained by treating surfaces of the fine particles with silicone, the treated fine particles containing not less than 5% of the silicone.

25 Claims, 1 Drawing Sheet

DEVELOPER FOR DEVELOPING ELECTROSTATIC LATENT IMAGE

BACKGROUND OF THE INVENTION

1. Field of the Invention

The present invention relates to a developer for developing an electrostatic latent image formed on a photosensitive body employed in, e.g., a printer or a facsimile machine and providing a visual image on a recording medium output from the printer or facsimile machine, and in particular to such a developer suitable for use in the field of electrostatic or electrophotographic image recording.

2. Related Art Statement

There are known a variety of electrophotographic image-developing processes each for developing an electrostatic latent image. Generally, those processes are be classified into one-component developing processes and two-component developing processes.

The one-component developing processes employ an image developing composition, i.e., developer which is provided by only a toner which forms a toner image corresponding to a latent image formed on a photosensitive body. The one-component developing processes include a first type of processes which employ a magnetic toner, and a second type of processes which employ a non-magnetic toner. In each of the first and second processes, the developer is formed into a thin layer on a toner conveyer. Meanwhile, the two-component developing processes employ a developer which contains 95 to 98% by weight of carrier and 2 to 5% by weight of toner, i.e., is provided by the carrier and the toner mixed in the respective contents. This toner is a non-magnetic toner. If a developer containing more than 5% of toner is employed, a "fog" phenomenon due to the toner occurs to a recording image transferred from a photosensitive body onto a recording medium such as a cut sheet. The "fog" is a dark veil of uniform density spread over all parts of the recording medium. Thus, the fog occurs to non-recording portions or areas on the recording medium, thereby lowering the quality of the recording image.

There is known to modify a two-component developing process so as to employ a developer containing a magnetic toner in an increased content. This process might be called as a one-and-half-component developing process, because it has some features of each of the one-component and two-component developing processes. The one-and-half-component developing process employs a developer which contains 30 to 80% of carrier and 20 to 70% of toner, and this developer is formed into a layer on a conveyer provided by a developing sleeve in which a magnetic roll is incorporated, like in the two-component developing processes. However, the thickness of the developer layer formed in the one-and-half developing process is greater than that of the developer layer formed in the one-component developing processes.

There is known an electrostatic latent image developing process in which a magnetic toner is employed which is mixed with an electrically conductive material such as carbon black and is made electrically conductive. In this process, the toner being conveyed on a surface of a developing sleeve is moved onto a photosensitive body on which an electrostatic latent image has been formed, because of an electric field produced between the photosensitive body and the developing sleeve, so that the latent image is developed with the toner into a toner image. This process does not need the frictional charging of the toner and accordingly can be carried out by a small-size apparatus. However, the toner image developed on the photosensitive body does not have such a great electrostatic force (i.e., large amount of electric charge) which ensures that the toner image is transferred from the photosensitive body to a recording medium. Thus, the efficiency or reliability of of transferring of the toner image onto the recording medium is very low, so that a "hollow print" phenomenon may occur to a recording image formed on the recording medium. The "hollow print" is one or more white (or sheet-color) spots which appear in recording portions or areas on the recording medium which should have a black color (or toner color).

There is also known an insulating image-developing process in which an electrically insulating magnetic toner is employed. The toner does not contain an electrically conductive material but contains a magnetic pigment which satisfies both a required magnetic binding force and a required degree of blackness of recording images. The toner contains, in addition to the magnetic powder, a binder resin which has a higher volume resistivity than that of the magnetic powder. Accordingly, although this toner is an insulating magnetic toner, the volume resistivity of the toner may change depending upon the amount of the magnetic powder contained therein.

Thus, the amount of the magnetic powder contained in the insulating magnetic toner is naturally limited to a certain range because both the image blackness and the magnetic binding force depend upon the amount of the magnetic powder. For example, since the magnetic powder functions as the pigment of the insulating magnetic toner, it is impossible to increase the content of the magnetic powder while simultaneously increasing the volume resistivity of the toner. Thus, even in the case where the insulating magnetic toner is employed, the "hollow print" phenomenon may occur, when a toner image is transferred to a recording medium, depending upon the volume resistivity of the toner employed or the other conditions of transferring of the toner image, like in the case of the conductive magnetic toner.

For solving the problem of the "hollow print" phenomenon, it has been proposed, other than to increase the volume resistivity of a toner, to employ a toner containing a metal soap such as zinc stearate. Although the toner containing the metal soap therein is free from the "hollow print" problem, the toner suffers from the "fog" problem being worse. When an image recorded on each of recording cut sheets is examined with respect to quality, the number of the image-recorded sheets which satisfy prescribed quality standards is reduced to about a half. Since the toner containing the metal soap can possess an increased amount of charge, the area of distribution of charge in the toner can increase, so that an amount of toner which possesses a reversed polarity can increase. Consequently the toner tends to adhere to image-free portions of a photosensitive body where no electrostatic latent image is present, and the adhered toner is transferred from the photosensitive body onto a recording medium. Thus, the "fog" problem becomes worse.

Thus, there is no electrostatic latent image developer which is free from both the "fog" and "hollow print" phenomena which can occur when an electrostatic latent image formed on a photosensitive body is developed into a visual image on a recording medium.

SUMMARY OF THE INVENTION

It is therefore an object of the present invention to provide an electrostatic latent image developer which ensures that, when a visual image is recorded on a recording medium, a toner image developed with the developer on a photosensitive body is smoothly transferred to the recording medium while the occurrence of "hollow print" phenomenon is fully prevented.

It is another object of the present invention to provide an electrostatic latent image developer which ensures that, when a visual image is recorded on a recording medium, a toner image developed with the developer on a photosensitive body is smoothly transferred to the recording medium while the occurrence of "fog" phenomenon is avoided as effectively as possible.

It is another object of the present invention to provide an electrostatic latent image developer which provides a visual image with high quality.

The above objects have been achieved by the present invention. According to a first aspect of the present invention, there is provided a developer for developing an electrostatic latent image formed on an photosensitive body, comprising a toner, a fluidity improving material, a cleaning material, and hydrophobic fine particles obtained by treating surfaces of the fine particles with silicone, the treated fine particles containing not less than 5% of the silicone.

In the electrostatic latent image developer in accordance with the first aspect of the invention, the surfaces of the fine particles are treated with the silicone and are made hydrophobic. The treated fine particles contain not less than 5% of the silicone. The treated fine particles ensures that, when a visual image is recorded on a recording medium, the toner (or toner image) adhered to the surface of a photosensitive body is smoothly transferred from the photosensitive body onto the recording medium while the occurrence of "hollow print" phenomenon is fully prevented.

According to a preferred feature of the first aspect of the invention, the fine particles comprise fine particles of titanium oxide.

According to another feature of the first aspect of the invention, the fine particles are selected from the group consisting of fine particles of silica, fine particles of alumina, fine particles of an organic material, fine particles of strontium oxide, and fine particles of strontium titanate.

According to another feature of the first aspect of the invention, the silicone comprises a silicone oil.

According to another feature of the first aspect of the invention, the developer further comprises a carrier, and the toner comprises a magnetic toner.

According to another feature of the first aspect of the invention, the fluidity improving material is selected from the group consisting of a fine powder of an inorganic compound such as silica, aluminum oxide and titanium oxide, a fine powder of acrylic resin, a fine powder of polyvinylfluoride, a fine powder of polyolefin, and a fine powder of polyamide. The fine powder of silica may be made hydrophobic. The hydrophobic silica fine powder or particles mainly improve the fluidity of the magnetic toner.

According to another feature of the first aspect of the invention, the cleaning material is selected from the group consisting of fine particles of alumina, and fine particles of a hard material such as carbide, nitride, carbonate, zirconium silicate, and magnesium oxide. The cleaning material, such as alumina fine particles, mainly cleans the surface of a photosensitive body. Since the photosensitive body is cleaned with high efficiency or reliability, the occurrence of "fog" phenomenon is avoided as effectively as possible.

According to a second aspect of the present invention, there is provided a developer for developing an electrostatic latent image formed on an photosensitive body, comprising a toner, a fluidity improving material, a cleaning material, and fine particles of crystalline titanium oxide having surfaces treated with silicone.

The developer in accordance with the second aspect of the invention enjoys the same advantages as those with the developer in accordance with the first aspect of the invention.

According to a preferred feature of the second aspect of the invention, the crystalline titanium oxide is selected from the group of rutile-type titanium dioxide and anatase-type titanium dioxide.

According to a third aspect of the present invention, there is provided a developer for developing an electrostatic latent image formed on an photosensitive body, comprising a magnetic toner, a carrier, fine particles of hydrophobic silica, fine particles of alumina, and fine particles of titanium oxide having surfaces treated with silicone, the treated fine particles containing not less than 10% of the silicone.

The developer in accordance with the third aspect of the invention enjoys the same advantages as those with the developer in accordance with the first aspect of the invention.

According to a preferred feature of the third aspect of the invention, the magnetic toner comprises a binder resin, a magnetic powder, a releasing agent, and a charge control material.

According to another feature of the third aspect of the invention, the binder resin comprises at least one resin selected from the group consisting of polystyrene, polyacrylate, polymethacrylate, vinyl resin, polyester resin, polyethylene, polypropylene, polyvinylchloride, polyacrylonitrile, polyether, polycarbonate, cellulosic resin, polyamide, and a copolymer of two or more monomers of the resins.

According to another feature of the third aspect of the invention, the magnetic powder comprises a magnetic or magnetizable powder selected from the group consisting of a fine powder of metal such as iron, manganese, nickel, cobalt, and chromium, and a fine powder of metal oxide such as magnetite, hematite, and ferrite.

According to another feature of the third aspect of the invention, the releasing agent is selected from the group consisting of polyalkylene such as polyethylene and polypropylene, and a natural wax such as carnauba wax, candelilla wax, and rice wax.

According to another feature of the third aspect of the present invention, the charge control material is selected from the group consisting of nigrosine dye, quaternary ammonium salt, alkoxylated amine, alkylamide, a metal complex of azoic dye, and a metal salt of higher fatty acid.

According to another feature of the third aspect of the invention, the carrier comprises a magnetic powder selected from the group consisting of a powder of iron, a powder of nickel, a powder of cobalt, and a powder of ferrite.

According to another feature of the third aspect of the invention, the carrier further comprises at least one resin contained to coat the magnetic material, the at least one resin being selected from the group consisting of fluororesin, styrene resin, acrylic resin, silicone resin, epoxy resin, polyester resin, and polyalkylene resin.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
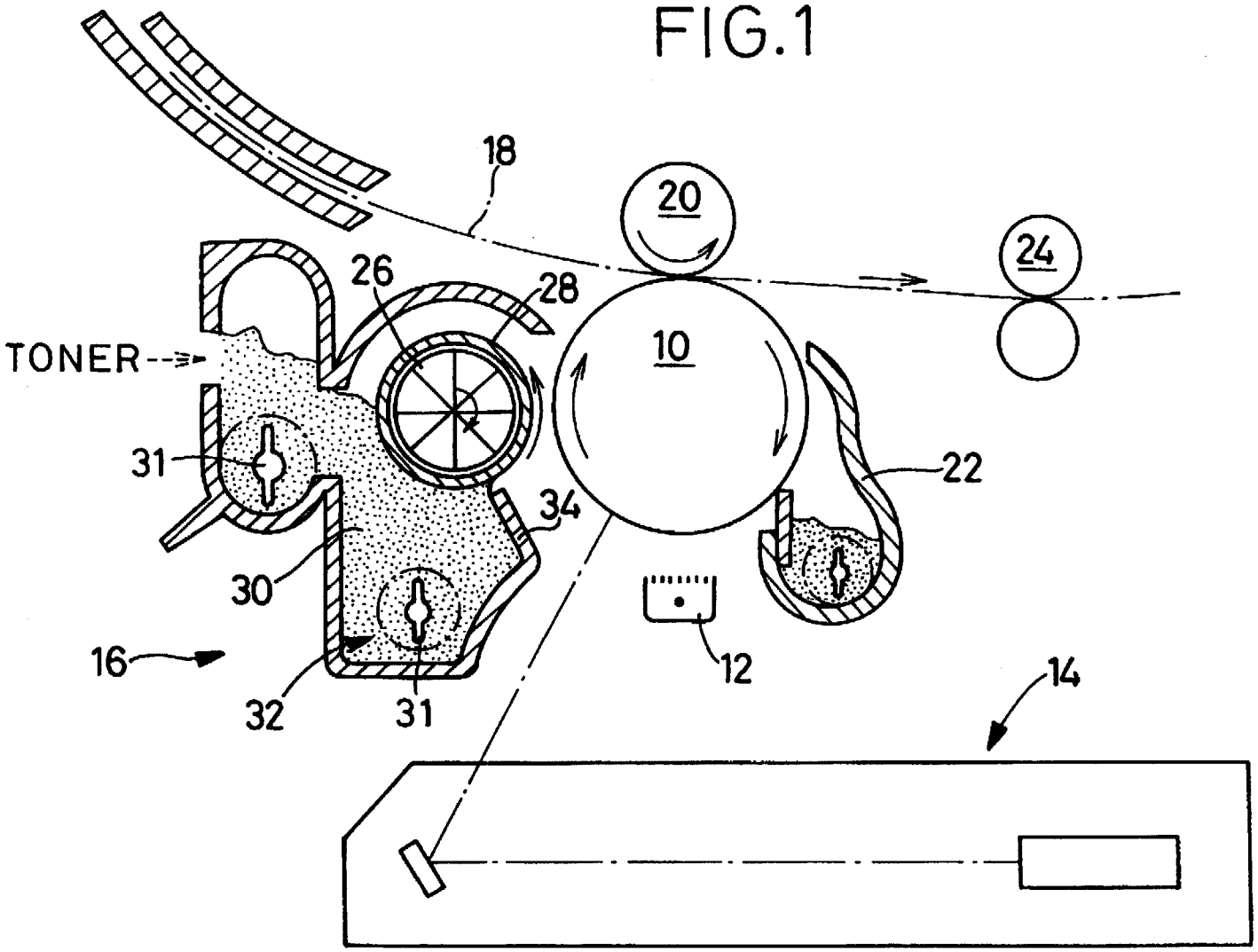
FIG. 1 is an illustrative view of a recording device of a laser-beam printer with which an electrostatic latent image developer in accordance with the present invention may be used.

There will be described in detail an electrostatic latent image developer embodying the present invention.

The present image developer basically includes a magnetic carrier and a magnetic toner.

The magnetic carrier includes a carrier material which may be a powder of a magnetic material such as iron, nickel, cobalt, and ferrite. The magnetic carrier is produced using the carrier material in the following manner: First, two or more appropriate magnetic powders selected from iron powder, nickel powder, cobalt powder, ferrite powder, and other suitable magnetic powders are mixed with each other in respective appropriate contents. This mixture is calcinated, and then is crushed into particles having a mean particle diameter of not more than 2 μm. The thus obtained particles are granulated so as to have a predetermined particle size, and then are burned at 1,250° to 1,350° C. for three to five hours. The carrier material is obtained by milling or classifying the burned particles. The thus obtained carrier material has a coercive force of not more than 5 Oe (oersted), a residual magnetization of not more than 5 emu/g, and a magnetic-flux saturated density of 80 to 200 emu/g. The smaller the particle diameter of the carrier material is, the higher the frequency of contacting of the carrier particles with toner particles is. Therefore, with a carrier material having a smaller particle diameter, a toner can more quickly be charged or electrified. On the other hand, a carrier material whose particle diameter is very small suffers from the problem that some of the carrier material is adversely transferred onto an operative surface of a photosensitive body. In view of this, it is preferred that the carrier material have an average particle diameter of 30 to 100 μm.

The magnetic carrier may consist of the thus obtained carrier material only. However, the carrier material or particles may be coated with one or more sorts of suitable resins which may be selected from fluororesins, styrene resins, acrylic resins, silicone resins, epoxy resins, polyester resins, and polyalkylene resins.

The magnetic toner includes one or more binder resins, a magnetic powder, a releasing agent, and a charge control material.

The binder resin or resins may be selected from polystyrene, polyacrylate, polymethacrylate, vinyl resins, polyester resins, polyethylene, polypropylene, polyvinylchloride, polyacrylonitrile, polyether, polycarbonate, cellulosic resins, polyamide, and various copolymers of the monomers of two or more of these resins. In particular, a copolymer of styrene monomer and an acryl monomer is preferably used as the binder resin.

The magnetic powder may be a magnetic or magnetizable material and may be selected from, for example, a fine powder of metal such as iron, manganese, nickel, cobalt, and chromium, and a fine powder of metal oxide such as magnetite, hematite, and ferrite.

The releasing agent may be a polyalkylene or a natural wax and may be selected from, for example, polyethylene, polypropylene, carnauba wax, candelilla wax, and rice wax.

The charge control material may be selected from nigrosine dyes, quaternary ammonium salts, alkoxylated amines, alkylamides, a metal complex of azoic dyes, and metal salts of higher fatty acids.

The present image developer further includes, as other additives, a fluidity improving material, hydrophobic fine particles of titanium oxide, and a cleaning material.

The fluidity improving material is used to improve the fluidity of the magnetic toner, and may be selected from a fine powder of an inorganic compound such as silica, aluminum oxide, and titanium oxide, a fine powder of acrylic resin, a fine powder of polyvinylfluoride, a fine powder of polyolefin, and a fine powder of polyamide. For example, in the case of a fine powder of silica, fine particles of silica may be used which have a BET specific surface area of 50 to 300 $m^2/g$. The surfaces of the silica fine particles are treated with a silicone having a silyl group such as aminosilane, trimethylsilane, dimethylsilane, and octylsilane, and thus are made hydrophobic. The silica fine particles treated with the surface treating agent enjoy a high environmental stability. Those silica particles adhere to the surfaces of the toner particles and exhibit the above-indicated effect of improving the fluidity of the toner particles. In the case where silica particles whose specific surface area is insufficiently small is used, the silica particles cannot sufficiently disperse into the toner particles and cannot sufficiently adhere to the surfaces of toner particles. Thus, those silica particles cannot exhibit a good effect of improving the fluidity of the toner particles. On the other hand, when silica particles sufficiently adhere to the surfaces of toner particles, the silica particles can effectively prevent the toner particles from directly contacting one another, thereby reducing the friction produced between the toner particles. More specifically described, even if the toner particles contact one another and produce friction therebetween, the silica particles dispersed between the toner particles function like rollers, thereby preventing the toner particles from being subjected to adverse stresses. Thus, the fluidity of the magnetic toner is improved.

It is preferred that the silica particles have a spherical shape. In the case where silica particles whose shape is different from the spherical shape are used, the silica particles suffer from an insufficiently low effect of behaving like rollers between the toner particles.

The fine particles of titanium oxide are added as a hollow-print preventing material, for preventing the occurrence of "hollow print" phenomenon. The titanium oxide particles may be fine particles of an anatase-type crystalline titanium dioxide which is produced by so-called "sulfuric acid" method and which has a purity of 85–95%. The surfaces of the titanium oxide particles are treated with silicone such as a silicone oil and thus are made hydrophobic. This treatment is carried out by impregnating the silicone oil into the surfaces of the titanium oxide particles. Otherwise, the surfaces of the titanium oxide particles may be treated with zinc stearate. The titanium oxide particles treated with the silicone oil contain 5 to 15% by weight of silicone oil, more preferably 10 to 15% by weight of silicone oil. The Inventors have first found that when the silicone-treated titanium oxide particles containing 5–15% of silicone are used with a magnetic toner, the toner can easily be separated from the operative surface of a photosensitive body and be transferred onto a recording medium. In the case where the silicone content of the silicone-treated titanium oxide particles is lower than the lower limit, i.e., 5%, the toner cannot easily be separated from the surface of the photosensitive body, and the "hollow print" phenomenon may occur. Meanwhile, in the case where the silicone content is higher than the upper limit, i.e., 15%, the properties of the silicone overcome the properties of the titanium oxide particles.

In the present embodiment, the surfaces of the titanium oxide particles are treated and made hydrophobic, in the above-indicated manner that is different from a known method wherein one various silanes may be reacted with the hydrophilic "—OH" groups of the titanium oxide which is synthesized. In the latter method, if dimethyldichlorosilane (DDCS) is used, the hydrogens, H, of the titanium oxide, Ti—OH, are removed from the surfaces of the titanium oxide particles, and simultaneously the chlorines, Cl, of the DDCS are removed, so that the Ti—O is bonded with dimethylsilane. Thus, the surfaces of the titanium oxide are made free from the hydrophilic "—OH" groups and thus are made hydrophobic.

However, the titanium oxide particles whose surfaces are bonded with the silane compounds cannot exhibit the effect of smoothly transferring the magnetic toner from the surface of the photosensitive body to the recording medium while preventing the occurrence of the "hollow print" phenomenon. In the present embodiment, the silicone oil is used as the surface treating material and is contained in the titanium oxide particles. The silicone oil is just mixed with the titanium oxide particles and thus is impregnated into the surfaces of those particles.

While in the present embodiment the silicone oil is impregnated into the fine particles of titanium oxide, it is possible to use other sorts of fine particles such as fine particles of silica, fine particles of alumina, and fine particles of an organic material.

In addition, the hollow-print preventing material may be obtained by treating, in the same manner as described above, other sorts of fine particles such as fine particles of strontium oxide and fine particles of strontium titanate, and making the surfaces of the fine particles hydrophobic. In this case, too, the silicone-oil content of the treated fine particles is not less than 5% by weight. The titanium oxide should have a crystal structure but may be either a rutile-type crystalline titanium dioxide or anatase-type crystalline titanium dioxide. However, non-crystalline titanium oxide, even treated and made hydrophobic, does not exhibit the effect of preventing the occurrence of "hollow print" phenomenon.

The cleaning material may be, for example, fine particles of alumina. When toner, silica particles, etc. left on an operative surface of a photosensitive body or drum 10 (FIG. 1) are removed by a cleaning blade 22, the alumina particles cooperate with the cleaning blade 22 to clean the photosensitive drum 10 with high efficiency or reliability. It is preferred that the alumina particles have a mean particle diameter of not less than 1 μm (or a BET specific surface area of 100±10 $m^2/g$) and do not have a spherical shape. Only alumina particles having not less than a certain particle diameter can exhibit a good cleaning effect, and alumina particles having a shape other than the spherical shape can more effectively clean the surface of the photosensitive drum 10. The alumina particles are dispersed in the toner particles.

The cleaning material is not limited to the fine particles of alumina and may be, for example, fine particles of a hard material such as carbide, nitride, carbonate, zirconium silicate, and magnesium oxide. The carbide may be tungsten carbide, tantalum carbide, or titanium carbide; the nitride may be silicon nitride, zirconium nitride, titanium nitride, or boron nitride; and the carbonate may be calcium carbonate, barium carbonate, or magnesium carbonate.

The present electrostatic latent image developer having the above-described composition may be used with various sorts of image recording devices or machines wherein an electrophotographic image developing process is employed.

FIG. 1 shows a recording device of a laser-beam printer with which the present image developer may be used to develop an electrostatic latent image and record or print the developed image on a recording medium 18. The principles of operation of the present image developer, i.e., image-developing composition will be described in detail by reference to FIG. 1.

The recording device of the laser-beam printer includes a photosensitive body or drum 10 which is obtained by providing a photoconductive layer on an outer circumferential surface of an aluminum-based electrically 10 conductive cylinder. The recording device further includes, around the photoconductive drum 10, a charging device 12, a laser scanner 14, a developing device 16, a transferring device 20, and a cleaning device 22. The charging device 12 electrically charges or electrifies the circumferential surface of the photoconductive drum 10 and thereby produces a surface potential on the photoconductive drum 10. The laser scanner 14 optically scans the charged surface of the drum 10 and thereby transmits image information to the drum 10. The transferring device 20 transfers a toner image developed on the scanned surface of the drum 10, onto a recording medium such as a recording sheet 18. The cleaning device 22 cleans or removes the toner which is not transferred by the transferring device 20 and is left on the drum 10. Thus, the recording device carries out an electrophotographic image developing process. In addition, the recording device includes a fixing device 24 which thermally fuses the toner image transferred onto the recording sheet 18 and thereby fixes the image on the sheet 18.

The developing device 16 includes a magnetic roll 26 and a non-magnetic developing sleeve 28 located radially outwardly of the magnetic roll 26. The magnetic roll 26 and the non-magnetic sleeve 28 are rotatable relative to each other in opposite directions, respectively. Meanwhile, the direction of rotation of the non-magnetic sleeve 28 is opposite to the direction of rotation of the photoconductive drum 10. The above-described electrostatic latent image developer 30 is supplied to a developer container of the developing device 16. The developer 30 is agitated by suitable agitators 31, so that the developer 30 is brought into contact with the developing sleeve 28. The developing sleeve 28 is necessarily rotated for conveying the developer 30, but the magnetic roll 26 may not be rotated.

More specifically described, the image developer 30 is accommodated in the developer container of the developing device 16 in which the developing sleeve 28 is provided. This developer container will be referred to as a carrier containment room 32 which is filled, before commencement of image development, with the image developer 30 which is obtained in advance by mixing at least the toner and the carrier. The carrier contained in the image developer 30 cannot be present, or be moved to, outside the carrier containment room 32 except for an exposed portion of an outer circumferential surface of the developing sleeve 28. The carrier is conveyed by the developing sleeve 28, to a position adjacent the photoconductive drum 10, but is not transferred onto the drum 10. However, the toner conveyed on the developing sleeve 28 is transferred onto the drum 10 to develop a latent image formed on the surface of the drum 10. Thus, the carrier is not consumed but the toner is consumed little by little. Depending upon the amount of consumption of the toner, additional toner is supplied to the carrier containment room 32 from a toner box (not shown) which communicates the room 32.

The developing device 16 includes a blade 34 which forms a developer layer having a predetermined thickness corresponding to a distance between the blade 34 and the developing sleeve 28. When the developing sleeve 28 is rotated, the developer 30 being in contact with the sleeve 28 is conveyed by the sleeve 28 and an excess of the developer 30 is removed by the blade 34. Thus, the developer 30 conveyed on the sleeve 28 contains both the toner and the carrier. Since the distance of the developing sleeve 28 and the blade 34 influences the quality of a visual image formed on the recording sheet 18, the distance is prescribed at a value smaller than a gap (e.g., 250 to 450 μm) between the photoconductive drum 10 and the developing sleeve 28. For example, in the case where the gap of the drum 10 and the sleeve 28 is 350 μm, the gap of the blade 34 and the sleeve 28 is controlled at 200 to 300 μm.

A 3 to 5 kV voltage is applied to the charging device 12 to produce corona discharge, so that the photoconductive drum 10 has a surface potential of about +700 V. The charging device 12 may include a scorotron which produces, by corona discharge, a predetermined surface potential on the drum 10, or a semiconductor brush, roller, blade, etc. which contacts the drum 10 and produces an appropriate surface potential on the drum 10.

The photoconductive drum 10 having the surface potential produced by the charging device 12 is exposed to laser beams which are emitted by the laser scanner 14 and which carry image information in terms of light signals transformed from electric signals. Because of the properties of the photoconductive layer provided on the photosensitive drum 10, the initial potential of portions of the drum surface 10 which are exposed to the laser beams emitted from the laser scanner 14 is lowered. Thus, different surface portions having different surface potentials, i.e., a distribution of potentials is produced on the drum 10. In other words, an electrostatic latent image is formed on the drum 10.

In the developing device 16, the developer layer 30 having a predetermined thickness is conveyed on the surface of the developing sleeve 28, and is bought into quasi-contact with the image-scanned surface of the photoconductive drum 10, so that only the toner contained in the developer layer 30 is transferred from the sleeve 28 onto the drum 10 to develop the electrostatic latent image formed on the drum 10. On the other hand, the carrier and a remainder of the toner left on the sleeve 28 are conveyed to the carrier containment room 32 and are utilized to charge, by friction, the toner present in the room 32. An electrostatic latent image is formed on the drum 10 because the initial 700 V surface potential produced by the charging device 12 is lowered to 100 V at only the portions exposed to the laser beams emitted from the laser scanner 14. Meanwhile, a 600 V bias voltage is applied to the developing sleeve 28, and thus the toner is charged to be electrically positive. The thus charged toner electrically adhere to only the exposed 100 V portions of the drum surface 10 and thereby develop the electrostatic latent image. Although in the present embodiment the toner is charged to be positive, it is possible to charge the toner to be negative. In the latter case, it is required that each element should have a reversed polarity.

The toner image developed on the photoconductive drum 10 is transferred onto the recording sheet 18 by the transferring device 20, and then is fused and fixed on the sheet 18 by the fixing device 24. Thus, a desired recording image is obtained on the sheet 18.

Next, there will be described the results of image-recording experiments carried out by operating the above-described laser-beam printer using various examples of the above-described electrostatic latent image developer in accordance with the present invention.

INVENTION EXAMPLE 1

| A. TONER PARTICLES | |
|---|---|
| a1. styrene-acryl copolymer resin (UNI 3000 available from SANYO CHEMICAL INDUSTRIES, LTD., JAPAN) | 100 parts by weight |
| a2. magnetite (MAT 305 available from TODA KOGYO CORP., JAPAN) | 70 parts by weight |
| a3. charge control material (N-01 available from ORIENT CHEMICAL INDUSTRIES, LTD., JAPAN) | 4 parts by weight |

Respective powders of the above-indicated three materials are mixed with one another while being heated, by using a kneading and extruding machine. Thus, the magnetite and the charge control material are dispersed in the resin. The thus heated and mixed materials are cooled, crushed into crude particles, and then milled into fine particles of the order of several micrometers. Further, the thus obtained fine particles are classified by an air classifier into a powder particles having a particle diameter of 3 to 20 μm.

100 parts by weight of the toner particles are mixed with the following addition agents:

| | |
|---|---|
| B. FLUIDITY IMPROVING MATERIAL | |
| hydrophobic fine powder of silica (particle diameter - 10 to 20 nm) | 1 part by weight |
| C. CLEANING MATERIAL | |
| fine powder of alumina (specific gravity - 5 g/cm$^3$) | 0.5 part by weight |
| D. HOLLOW-PRINT PREVENTING MATERIAL | |
| fine powder of titanium oxide: $TiO_2$ (containing 10% by weight of silicone oil) | 0.3 part by weight |

The thus obtained mixture is agitated by a Henschel mixer, so as to obtain a dry toner.

10 parts by weight of this toner is mixed with 50 parts by weight of a ferrite as E. CARRIER, so as to obtain an image developer as an example of the previously-described electrostatic latent image developer. This developer is supplied to the carrier containment room 32 of the developing device 16 of the laser-beam printer shown in FIG. 1, and 150 g of the above-indicated toner is supplied to the toner box or cartridge (not shown) which communicates the room 32. Then, the printer is operated to record an image pattern on each of thick cut sheets (XEROX 4024—28-pound paper).

After the printer prints the same image pattern on each of one thousand sheets, a person identifies, by his or her naked eyes, whether the "hollow print" phenomenon has occurred to the image pattern recorded on the thousandth sheet. In addition, after the printer prints the same image pattern on each of two thousand sheets, whether the "fog" phenomenon has occurred to the image pattern produced on the two thousandth sheet is identified in the following manner:

Measurement of "FOG"

The "fog" is measured or evaluated as follows:

(1) First, a degree of whiteness of a blank sheet on which no image is recorded is measured by a spectrophotometric colorimeter available from SUGA TEST INSTRUMENT CORP., JAPAN;

(2) Next, a degree of whiteness of a portion of the two thousandth sheet which portion has no recording image is measured in the same manner; and (3) Then, a "fog" index is obtained as a difference of the two whiteness degrees measured in the above two steps.

A "fog" index not greater than 2.0 is generally thought to be normal within a permissible range. The manner of measurement of the "fog" index is basically the same as that disclosed in Japanese Patent Application No. 5(1993)-337339, and the detailed description of the manner is omitted.

Table 1 shows the examined result of the "hollow print" phenomenon, and the measured "fog" index, with respect to Invention Example 1.

The test results of Invention Example 1 shown in Table 1 indicates that the image developer including 0.3 part by weight of fine powder of titanium oxide containing 10% by weight of silicone oil is free from the problem of the "hollow print" phenomenon after the developer is used to produce one thousand copies and that the "fog" index measured on the developer is 1.3 falling within the permissible range, after the developer is used to produce two thousand copies. The complete transferring of the toner image from the photoconductive drum 10 to each recording sheet 18 is thought to result from the presence of the hydrophobic titanium oxide powder containing 10% of silicone oil. The sufficiently low "fog" index is thought to result from the presence of the alumina powder that operates for cleaning the surface of the drum 10 with high efficiency.

TABLE 1

| | A*1 | B*2 | HOLLOW PRINT | FOG INDEX |
|---|---|---|---|---|
| INVENTION EXAMPLE 1 | 0.3 | 10 | –*4 | 1.3 |
| INVENTION EXAMPLE 2 | 0.1 | 15 | – | 1.5 |
| INVENTION EXAMPLE 3 | 1 | 10 | – | 1.7 |
| INVENTION EXAMPLE 4 | 0.5 | 5 | ±*5 | 1.3 |
| COMPARATIVE EXAMPLE 1 | 0 | 0 | ++*6 | 1.5 |
| COMPARATIVE EXAMPLE 2 | C*3 0.3 | 0 | – | 3.5 |
| COMPARATIVE EXAMPLE 3 | 0.5 | 0 | +*7 | 1.5 |

*1: "A" is titanium oxide (part by weight)
*2: "B" is silicone oil (% by weight)
*3: "C" is zinc stearate (part by weight)
*4: not occurred
*5: slightly occurred
*6: remarkably occurred
*7: occurred

INVENTION EXAMPLE 2

A second image developer used in Invention Example 2 is different from that used in Invention Example 1 only in that the titanium oxide powder used in the first developer of Invention Example 1 is replaced by 0.1 part by weight of titanium oxide powder containing 15% by weight of silicone oil. The other components and contents of the second developer are the same as those of the first developer.

Under the same conditions as those employed in Invention Example 1, the laser printer shown in FIG. 1 is operated using the thus obtained second developer to record an image pattern on each of recording cut sheets. The "hollow print" phenomenon and the "fog" index are examined and measured on the thousandth sheet and the two thousandth sheet, respectively, in the same manner as described above with respect to Invention Example 1. The obtained results are shown in Table 1.

Table 1 indicates that the "hollow print" phenomenon does not occur after the developer is used to produce one thousand copies and that the "fog" index measured on the developer is 1.5 falling within the permissible range, even after the developer is used to produce two thousand copies. These are thought to result from the same reasons as described above with respect to Invention Example 1.

INVENTION EXAMPLE 3

A third image developer used in Invention Example 3 is different from that used in Invention Example 1 only in that the titanium oxide powder used in the first developer of Invention Example 1 is replaced by 1 part by weight of titanium oxide powder containing 10% by weight of silicone oil. The other components and contents of the third developer are the same as those of the first developer.

Under the same conditions as those employed in Invention Example 1, the laser printer shown in FIG. 1 is operated using the thus obtained third developer to record an image pattern on each of recording cut sheets. The "hollow print" phenomenon and the "fog" index are examined and measured on the thousandth sheet and the two thousandth sheet, respectively, in the same manner as described above with respect to Invention Example 1. The obtained results are shown in Table 1.

Table 1 indicates that the "hollow print" phenomenon does not occur after the developer is used to produce one thousand copies and that the "fog" index measured on the developer is 1.7 falling within the permissible range, even after the developer is used to produce two thousand copies. These are thought to result from the same reasons as described above with respect to Invention Example 1.

INVENTION EXAMPLE 4

A fourth image developer used in Invention Example 4 is different from that used in Invention Example 1 only in that the titanium oxide powder used in the first developer of Invention Example 1 is replaced by 0.5 part by weight of titanium oxide powder containing 5% by weight of silicone oil. The other components and contents of the fourth developer are the same as those of the first developer.

Under the same conditions as those employed in Invention Example 1, the laser printer shown in FIG. 1 is operated using the thus obtained fourth developer to record an image pattern on each of recording cut sheets. The "hollow print" phenomenon and the "fog" index are examined and measured on the thousandth sheet and the two thousandth sheet, respectively, in the same manner as described above with respect to Invention Example 1. The obtained results are shown in Table 1.

Table 1 indicates that the "hollow print" phenomenon slightly occurs after the developer is used to produce one thousand copies and that the "fog" index measured on the developer is 1.3 falling within the permissible range, even after the developer is used to produce two thousand copies. The slight occurrence of "hollow print" is thought to result from slightly insufficient toner-transferring effect of the titanium oxide powder containing the lower limit (5%) of silicone oil. Regarding the "fog" phenomenon, the sufficiently low "fog" index is thought to result from the presence of the alumina powder that operates for cleaning the surface of the drum 10 with high efficiency.

Regarding the examination of the "hollow print" phenomenon and the measurement of the "fog" index, three comparative experiments are carried out so that the results of the comparative experiments can be compared with the above-described results of Invention Examples 1 to 4.

COMPARATIVE EXAMPLE 1

A fifth image developer used in Comparative Example 1 is different from that used in Invention Example 1 only in that the titanium oxide powder used in the first developer of Invention Example 1 is not contained in the fifth developer. The other components and contents of the fifth developer are the same as those of the first developer. Under the same conditions as those employed in Invention Example 1, the laser printer shown in FIG. 1 is operated using the thus obtained fifth developer to record an image pattern on each of recording cut sheets. The "hollow print" phenomenon and the "fog" index are examined and measured on the thousandth sheet and the two thousandth sheet, respectively, in the same manner as described above with respect to Invention Example 1. The obtained results are shown in Table 1.

Regarding the fifth developer, the "hollow print" phenomenon starts to occur around the fiftieth sheet and, after the developer is used to produce one thousand copies, it remarkably occurs as indicated in Table 1. The "fog" index measured on the developer is 1.5 after the developer is used to produce two thousand copies. The reason why the "hollow print" remarkably occurs is thought to be such that the fifth developer includes no titanium oxide powder containing silicone oil and the toner image cannot smoothly be transferred from the photoconductive drum 10 onto each recording sheet 18. On the other hand, regarding the "fog" phenomenon, the sufficiently low "fog" index is thought to result from the presence of the alumina powder that operates for cleaning the surface of the drum 10 with high efficiency.

COMPARATIVE EXAMPLE 2

A sixth image developer used in Comparative Example 2 is different from that used in Invention Example 1 only in that the titanium oxide powder used in the first developer of Invention Example 1 is replaced by 0.3 part by weight of zinc stearate in the sixth developer. The other components and contents of the sixth developer are the same as those of the first developer. Under the same conditions as those employed in Invention Example 1, the laser printer shown in FIG. 1 is operated using the thus obtained sixth developer to record an image pattern on each of recording cut sheets. The "hollow print" phenomenon and the "fog" index are examined and measured on the thousandth sheet and the two thousandth sheet, respectively, in the same manner as described above with respect to Invention Example 1. The obtained results are shown in Table 1.

Regarding the sixth developer, the "hollow print" phenomenon does not occur after the developer is used to produce one thousand copies. As previously described, the metallic soap (i.e., zinc stearate) contained in the developer operates for preventing the "hollow print" phenomenon. However, the "fog" index measured on the developer is 3.5 that is largely deviated from the upper limit, 2.0, of the permissible range, after the developer is used to produce two thousand copies. The reason why the "fog" index is excessively high is thought to be such that the metallic soap mixed with the toner increases the amount of charge of the toner, and thereby widens the distribution of charge of the toner. Consequently the amount of toner with a reversed polarity increases, and some of the toner adversely adheres to image-free portions of the photoconductive surface of the drum 10, and are transferred to the recording sheet 18. For those reasons, the "fog" index increases.

COMPARATIVE EXAMPLE 3

A seventh image developer used in Comparative Example 3 is different from that used in Invention Example 1 only in that the titanium oxide powder used in the first developer of Invention Example 1 is replaced by 0.5 part by weight of titanium oxide powder not containing silicone oil in the seventh developer. The other components and contents of the seventh developer are the same as those of the first developer. Under the same conditions as those employed in Invention Example 1, the laser printer shown in FIG. 1 is operated using the thus obtained seventh developer to record an image pattern on each of recording cut sheets. The "hollow print" phenomenon and the "fog" index are examined and measured on the thousandth sheet and the two thousandth sheet, respectively, in the same manner as described above with respect to Invention Example 1. The obtained results are shown in Table 1.

Regarding the seventh developer, the "hollow print" phenomenon occurs around the thousandth sheet and the "fog" index measured on the developer is 1.5 after the developer is used to produce two thousand copies. The reason why the "hollow print" occurs is thought to be such that the titanium oxide powder used in the seventh developer is not treated with silicone oil or made hydrophobic and the toner-image-transferring effect of that titanium oxide powder is insufficiently low. On the other hand, regarding the "fog" phenomenon, the sufficiently low "fog" index is thought to result from the presence of the alumina powder that operates for cleaning the photoconductive surface of the drum 10 with high reliability.

As is apparent from the foregoing description of the results obtained from Invention Examples 1 to 4 and Comparatively Examples 1 to 3, the electrostatic latent image developers in accordance with the present invention include the titanium oxide particles which are treated with silicone oil and made hydrophobic and which contain 5 to 15% of silicone oil. Each invention developer further includes the alumina particles as the cleaning material for cleaning the photoconductive body 10. Thus, each invention developer ensures that a toner (or toner image) is smoothly transferred from the photoconductive body 10 to the recording sheet 18 while the occurrence of "hollow print" phenomenon is fully prevented. In addition, the "fog" phenomenon is avoided as effectively as possible from occurring to the recording sheet 18, since the alumina powder operates for cleaning the photoconductive surface of the photosensitive drum 10 with high reliability.

INVENTION EXAMPLE 5

An eighth image developer used in Invention Example 5 is different from that used in Invention Example 1 only in that the hydrophobic silica powder used as the fluidity improving material in the first image developer of Invention Example 1 is replaced by 1 part by weight of fine powder of non-crystalline aluminum oxide, in the eighth developer. The other components and contents of the eighth developer are the same as those of the first developer. The aluminum oxide powder used as the fluidity improving material may be different from the aluminum oxide or alumina powder used as the cleaning material. It is preferred that the aluminum oxide powder as the fluidity improving material have a specific gravity of 10 to 200 g/L and a particle diameter of not more than 1 μm.

Under the same conditions as those employed in Invention Example 1, the laser printer shown in FIG. 1 is operated using the thus obtained eighth developer to record an image pattern on each of recording cut sheets. The "hollow print" phenomenon and the "fog" index are examined and measured on the thousandth sheet and the two thousandth sheet, respectively, in the same manner as described above with respect to Invention Example 1. The obtained results are shown in Table 2.

Table 2 indicates that the image developer of Invention Example 5 is free from the problem of the "hollow print" phenomenon after the developer is used to produce one thousand copies and that the "fog" index measured on the developer is 0.8 falling within the permissible range, after the developer is used to produce two thousand copies.

TABLE 2

| | FLUIDITY IMPROVING MATERIAL | HOLLOW PRINT | FOG INDEX |
|---|---|---|---|
| INVENTION EXAMPLE 1 | HYDROPHOBIC SILICA POWDER | –*4 | 1.3 |
| INVENTION EXAMPLE 5 | ALUMINUM OXIDE POWDER | – | 0.8 |
| INVENTION EXAMPLE 6 | TITANIUM OXIDE POWDER | – | 1.2 |

*4:not occurred

INVENTION EXAMPLE 6

A ninth image developer used in Invention Example 6 is different from that used in Invention Example 1 only in that the hydrophobic silica powder used as the fluidity improving material in the first image developer of Invention Example 1 is replaced by 1 part by weight of fine powder of non-crystalline titanium oxide which does not contain silicone oil, in the ninth developer. The other components and contents of the ninth developer are the same as those of the first developer. The titanium oxide powder used as the fluidity improving material may be different from the titanium oxide powder used as the hollow-print preventing material. It is preferred that the titanium oxide powder as the fluidity improving material have a specific gravity of 10 to 200 g/L and a particle diameter of not more than 1 μm.

Under the same conditions as those employed in Invention Example 1, the laser printer shown in FIG. 1 is operated using the thus obtained ninth developer to record an image pattern on each of recording cut sheets. The "hollow print" phenomenon and the "fog" index are examined and measured on the thousandth sheet and the two thousandth sheet, respectively, in the same manner as described above with respect to Invention Example 1. The obtained results are shown in Table 2.

Table 2 indicates that the image developer of Invention Example 6 is free from the problem of the "hollow print" phenomenon after the developer is used to produce one thousand copies and that the "fog" index measured on the developer is 1.2 falling within the permissible range, after the developer is used to produce two thousand copies.

While the present invention has been described in its preferred embodiments, the present invention may otherwise be embodied.

For example, although the illustrated embodiments relate to the image developers each of which contains a magnetic toner and a carrier mixed with each other and which are employed in the one-and-half-component developing processes, the principle of the present invention can also be utilized to provide image developers which are suitable for the one-component or two-component developing processes and which effectively prevent the occurrence of "hollow print" phenomenon.

It is to be understood that the present invention may be embodied with various changes, improvements, and modifications that may occur to those skilled in the art without departing from the spirit and scope of the invention defined in the appended claims.

What is claimed is:

1. A developer for developing an electrostatic latent image formed on a photosensitive body, comprising:

a toner;

a fluidity improving material;

a cleaning material; and hydrophobic fine particles obtained by treating surfaces of said fine particles with silicone oil, the treated fine particles containing not less than 5% of said silicone oil, said fine particles comprising crystalline titanium oxide obtained by a sulfuric acid method and consisting of one of a rutile-type titanium dioxide and anatase-type titanium dioxide.

2. A process for developing an electrostatic latent image, comprising:

forming an image on a photosensitive body;

developing said image with a developer to form a toner image; and transferring said toner image onto a recording medium, wherein said developer comprises:

a magnetic toner;

a carrier;

fine particles of hydrophobic silica;

fine particles of alumina; and fine particles of crystalline titanium oxide having surfaces treated with silicone oil, the treated fine particles containing not less than 10% of said silicone oil, and wherein said fine particles of crystalline titanium are selected from the group consisting of one of a rutile-type titanium dioxide and anatase-type titanium dioxide, and wherein said crystalline titanium oxide is obtained by a sulfuric-acid method.

3. A developer according to claim 1, further comprising a carrier, wherein said toner comprises a magnetic toner.

4. A developer according to claim 1, wherein said fluidity improving material is selected from the group consisting of a fine powder of an inorganic compound such as silica, aluminum oxide and titanium oxide, a fine powder of acrylic resin, a fine powder of polyvinylfluoride, a fine powder of polyolefin, and a fine powder of polyamide.

5. A developer according to claim 1, wherein said cleaning material is selected from the group consisting of fine particles of alumina, and fine particles of a hard material such as carbide, nitride, carbonate, zirconium silicate, and magnesium oxide.

6. A developer for developing an electrostatic latent image formed on a photosensitive body, comprising:

a toner;

a fluidity improving material;

a cleaning material; and fine particles of crystalline titanium oxide having surfaces treated with silicone oil, said fine particles of crystalline titanium oxide being obtained by a sulfuric acid method and consisting of one of a rutile-type titanium dioxide and anatase-type titanium dioxide.

7. A developer according to claim 6, further comprising a carrier, wherein said toner comprises a magnetic toner.

8. A developer according to claim 6, wherein the treated fine particles contain not less than 5% of said silicone oil.

9. A developer for developing an electrostatic latent image formed on a photosensitive body, comprising:

a magnetic toner;

a carrier;

fine particles of hydrophobic silica;

fine particles of alumina; and fine particles of crystalline titanium oxide having surfaces treated with silicone oil, the treated fine particles containing not less than 10% of said silicone oil, said fine particles of crystalline titanium oxide being obtained by a sulfuric acid method and consisting of one of a rutile-type titanium dioxide and anatase-type titanium dioxide.

10. A developer according to claim 9, wherein said magnetic toner comprises:

a binder resin;

a magnetic powder;

a releasing agent; and a charge control material.

11. A developer according to claim 10, wherein said binder resin comprises at least one resin selected from the group consisting of polystyrene, polyacrylate, polymethacrylate, vinyl resin, polyester resin, polyethylene, polypropylene, polyvinylchloride, polyacrylonitrile, polyether, polycarbonate, cellulosic resin, polyamide, and a copolymer of two or more monomers of the resins.

12. A developer according to claim 10, wherein said magnetic powder comprises a magnetic or magnetizable powder selected from the group consisting of a fine powder of metal such as iron, manganese, nickel, cobalt, and chromium, and a fine powder of metal oxide such as magnetite, hematite, and ferrite.

13. A developer according to claim 10, wherein said releasing agent is selected from the group consisting of polyalkylene such as polyethylene and polypropylene, and a natural wax such as carnauba wax, candelilla wax, and rice wax.

14. A developer according to claim 10, wherein said charge control material is selected from the group consisting of nigrosine dye, quaternary ammonium salt, alkoxylated amine, alkylamide, a metal complex of azoic dye, and a metal salt of higher fatty acid.

15. A developer according to claim 9, wherein said carrier comprises a magnetic powder selected from the group consisting of a powder of iron, a powder of nickel, a powder of cobalt, and a powder of ferrite.

16. A developer according to claim 15, wherein said carrier further comprises at least one resin contained to coat said magnetic material, said at least one resin being selected from the group consisting of fluororesin, styrene resin, acrylic resin, silicone resin, epoxy resin, polyester resin, and polyalkylene resin.

17. A developer according to claim 1, wherein said treated fine particles contain 5 to 15% of said silicone oil.

18. A developer according to claim 1, wherein said treated fine particles contain 5 to 15% of said silicone oil.

19. A developer according to claim 8, wherein said treated fine particles contain 5 to 15% of said silicone oil.

20. A developer according to claim 19, wherein said treated fine particles contain 10 to 15% of said silicone oil.

21. A developer according to claim 9, wherein said treated fine particles contain 10 to 15% of said silicone oil.

22. A developer according to claim 9, wherein said treated fine particles contain 10 to 15% of said silicone oil.

23. A process for developing an electrostatic latent image, comprising:

forming an image on a photosensitive body;

developing said image with a developer to form a toner image; and transferring said toner image onto a recording medium, wherein said developer comprises:

a toner;

a fluidity improving material;

a cleaning material; and hydrophobic fine particles obtained by treating surfaces of said fine particles with silicone oil, the treated fine particles containing not less than 5 % of said silicone oil, wherein said fine particles comprise crystalline titanium oxide selected from the group consisting of one of a rutile-type titanium dioxide and anatase-type titanium dioxide, and wherein said crystalline titanium oxide is obtained by a sulfuric-acid method.

24. A process for developing an electrostatic latent image, comprising:

forming an image on a photosensitive body;

developing said image with a developer to form a toner image; and transferring said toner image onto a recording medium, wherein said developer comprises:

a toner;

a fluidity improving material;

a cleaning material; and fine particles of crystalline titanium oxide having surfaces treated with silicone oil, wherein said fine particles of crystalline titanium oxide are obtained by a sulfuric-acid method and consist of one of a rutile-type titanium dioxide and anatase-type titanium dioxide.

25. A developer according to claim 24, wherein said treated fine particles contain 10 to 15% of said silicone oil.

* * * * *